US009133755B2

(12) United States Patent
Liang et al.

(10) Patent No.: US 9,133,755 B2
(45) Date of Patent: Sep. 15, 2015

(54) ENGINE COMPONENT INSTALLATION FEATURE AND METHOD

(75) Inventors: Qiyu Liang, Peoria, IL (US); Arun Aakalu Ashok, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 402 days.

(21) Appl. No.: 13/564,482

(22) Filed: Aug. 1, 2012

(65) Prior Publication Data

US 2014/0034007 A1 Feb. 6, 2014

(51) Int. Cl.
*F01P 7/14* (2006.01)
*F01P 3/00* (2006.01)
*F01P 11/04* (2006.01)

(52) U.S. Cl.
CPC . *F01P 3/00* (2013.01); *F01P 11/04* (2013.01); *F01P 2031/00* (2013.01); *Y10T 29/49826* (2015.01)

(58) Field of Classification Search
CPC . F01P 11/04; F01P 2031/00; Y10T 29/49826
USPC ..... 123/41.08; 236/101 R, 101 C, 99 K, 34, 236/34.5
See application file for complete search history.

(56) References Cited

U.S. PATENT DOCUMENTS

| | | | |
|---|---|---|---|
| 4,245,781 | A | 1/1981 | Sliger |
| 4,431,133 | A | 2/1984 | Roberson |
| 4,763,834 | A | 8/1988 | Duprez |
| 4,982,704 | A | 1/1991 | Sliger |
| 5,018,664 | A | 5/1991 | Butler |
| 6,244,516 | B1 | 6/2001 | Langervik et al. |
| 6,578,769 | B1 | 6/2003 | Mathew et al. |
| 7,210,846 | B2 | 5/2007 | Mathew |
| 7,249,576 | B2 | 7/2007 | Jones |
| 7,422,159 | B2 | 9/2008 | Dehnen et al. |
| 2010/0077583 | A1 * | 4/2010 | Takaya ..... 29/213.1 |

FOREIGN PATENT DOCUMENTS

| | | |
|---|---|---|
| JP | 2008/291803 | 12/2008 |

* cited by examiner

*Primary Examiner* — Hung Q Nguyen
(74) *Attorney, Agent, or Firm* — Miller, Matthias & Hull LLP

(57) ABSTRACT

An engine component incorporates an installation feature for minimizing probability of misassembly of the component to or within an engine structure. For example, a ventless thermostatic valve may be made distinguishable from a vented, but otherwise identical, thermostatic valve, via the provision of tabs extending upwardly from the top of the ventless thermostatic valve. The tabs may be received into a corresponding tab-receiving groove of an associated engine part. As such, the tabs of the ventless component may offer a tactically sensitive distinguishing feature to signal that something may be amiss during an engine installation. The corresponding tab-receiving groove may be a widened aperture within a radiator elbow sleeve into which an upper portion of the ventless thermostatic valve may be mated and secured between an elbow sleeve flange and a cylinder head. Finally, a method of using the installation feature to reduce opportunities for misassembly error is disclosed.

11 Claims, 7 Drawing Sheets

ENGINE COMPONENT INSTALLATION FEATURE AND METHOD

TECHNICAL FIELD

An engine component installation feature and method may be employed to minimize probability of error during an engine assembly process. More particularly, the disclosure offers an apparatus and method for distinguishing between two substantially similar parts to reduce the potential of inadvertent misinstallation of similar but incorrect parts, including thermostatic valves, within engine structures such as cylinder heads.

BACKGROUND

While varieties of available machines, including front wheel loaders, excavators, road graders, milling machines, and the like, have become legion, the engines required to power such machines have become increasingly sophisticated and complex. As such, internal components required to build the engines have become more management intensive. By way of example, various parts employed in such machines may have different characteristics, such as operating conditions and ranges, even though the visual appearances of such parts may have only slight or subtle distinctions.

As one specific example, a thermostatic valve may include a small and nearly inconspicuous vent, while another thermostatic valve may be designed without such vent. Indeed the latter may be operationally suited and hence properly functional to prevent the overcooling of a newer or different engine. Accordingly, the installation of the vented thermostatic valve in an engine application requiring a ventless thermostatic valve, or vice versa, could lead to undesirable operation of the engine. Among various choices for avoiding misinstallation error, the obvious, such as color changes and/or changes in component sizing, may not always be practical. In addition, issues associated with mounting of and/or the securement of various components within engines may dictate uses of substantially standardized parts to the maximum possible extent.

U.S. Pat. No. 4,982,704 discloses a vehicle thermostat adapted for placement within the opening of an outlet housing. The outlet housing includes a positioning feature for assuring proper orientation of the thermostat within the opening of the outlet housing; the outlet housing has a slot, while the thermostat housing has a corresponding tab structure adapted for engagement with the slot. As such, the '704 patent addresses only angular orientation of one part with respect to another.

Accordingly, it may be beneficial to provide an apparatus and method for avoiding unintended installation of a first component in place of a second similar and/or potentially confusing component within an engine exterior or interior, without necessity of making undue changes in their shapes and/or sizes to avoid misinstallation errors.

SUMMARY OF THE DISCLOSURE

In one disclosed embodiment, an installation feature may provide a tactically sensitive apparatus adapted to minimize probability of misassembly of an engine component to or within an engine structure. For example, a ventless thermostatic valve may be distinguishable from a vented, but otherwise identical, thermostatic valve via the provision of tabs that extend axially upwardly from the top of the ventless thermostatic valve. The tabs may be received in corresponding tab-receiving grooves, slots, or detents within a portion of an engine part adapted to be mated with the ventless component. For this purpose, a corresponding tab mating portion, for example a widened aperture in a radiator elbow sleeve into which, by way of further example, an upper portion of the ventless thermostatic valve may be mated, may be operable to secure the component between an elbow sleeve flange and a cylinder head.

In accordance with one aspect of the disclosure, an engine component may be installed under a specific protocol designed to avoid misapplication of, for example, an installation of a vented thermostatic valve where a ventless thermostatic valve should be installed.

In accordance with another aspect of the disclosure, the component may be oriented and positioned relative to one associated engine part prior to the installation of the resulting subassembly in an engine.

In accordance with a further aspect of the disclosure, the tabs and tab-receiving grooves may together provide an installation distinguishing feature to be utilized on one of two components for error avoidance, for example, for the inadvertent misinstallation of one component over the other.

In accordance with a further aspect of the disclosure, a method of error avoidance may include the association of a tab structure on one of two components and a grooved tab-receiving structure on an engine part with which the tabbed component may be associated, the association assuring that the tabbed component will be less likely mated to an incorrect engine part.

In accordance with a still further aspect of the disclosure, an installation distinguishing apparatus for one of two substantially similar components may include a plurality of tabs, and the tab-receiving groove of an associated engine part may extend 360° about the periphery of a flange on the associated engine part.

DETAILED DESCRIPTION

A typical internal combustion engine (not shown) may be used to supply motive power to a machine. The engine may generally include an array of elongated bores, called cylinders, as well as pistons (neither shown) that move reciprocally, albeit linearly, within the cylinders. The pistons are attached to a crankshaft (not shown) adapted to convert the linear motion of the pistons into rotary motion, as may be employed to rotate a machine driveshaft. Spark plugs (not shown) may be employed to sequentially burn an oxygenated combustible, i.e. a fuel, to create the piston movements. Alternatively, as for example in a diesel engine, heat of compression created by movement of the pistons, rather than spark plugs, may be sufficient to produce combustion for piston movement. In any event, the combustion process generates heat that may be transferred to and carried away by a coolant fluid. The fluid may be conveyed by a pump to a radiator (not shown) for appropriate cooling and return to the engine, as will be appreciated by those skilled in this art.

Figure 1:
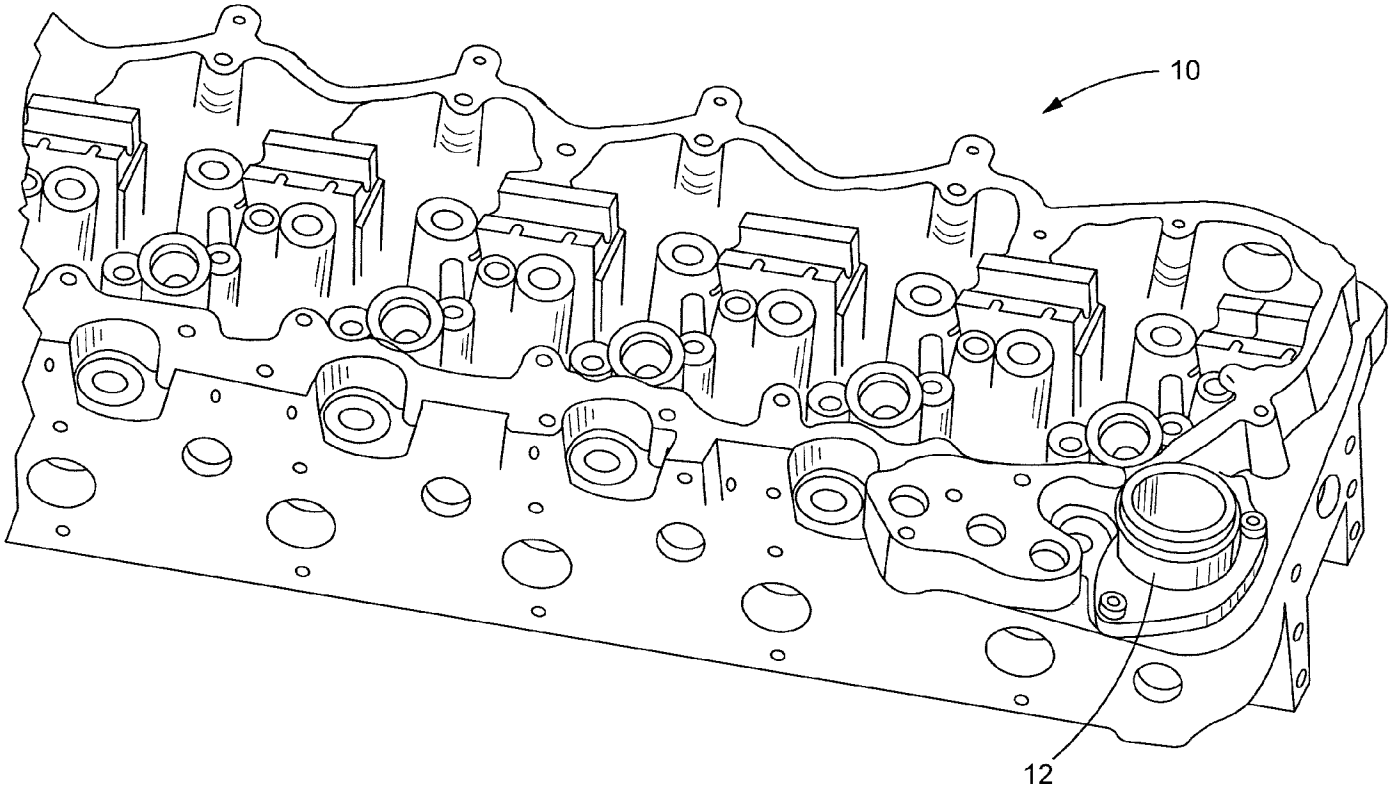
FIG. 1 (Prior Art)
FIG. 1 is a perspective view of a prior art engine cylinder head that may incorporate an engine component according to the present disclosure.

Referring to FIG. 1, an engine structure such as a cylinder head 10, conventionally situated immediately above the pistons, is shown without a cover, to reveal an engine water cooling subassembly 12. During a typical engine assembly process, various parts are assembled in sequence. Such parts include those of the subassembly 12.

Figure 2:
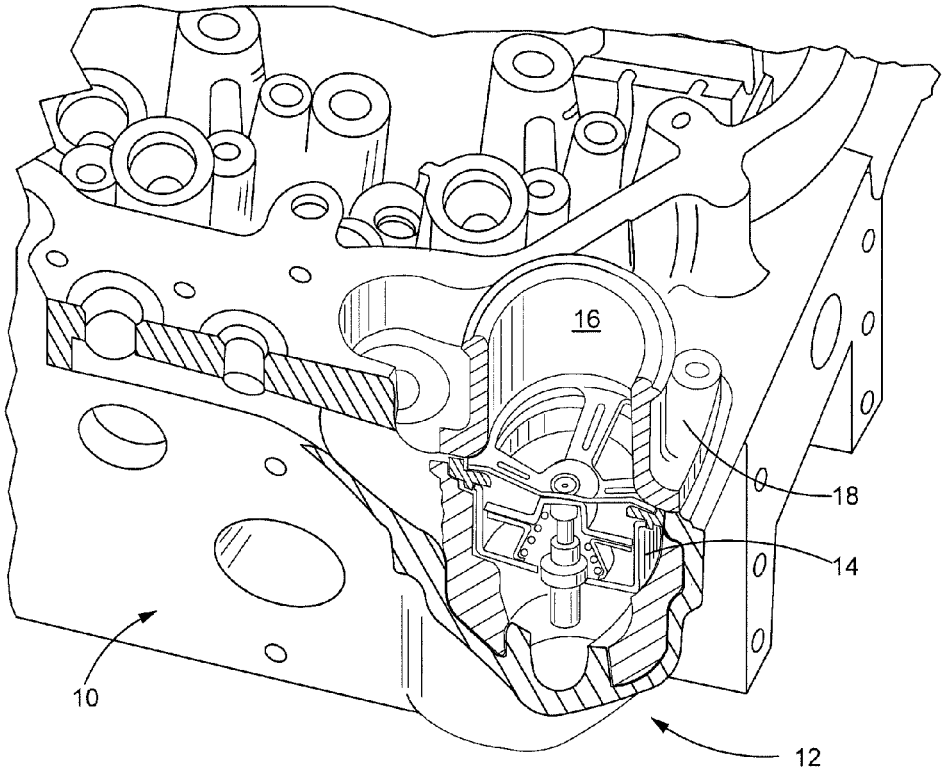
FIG. 2 (Prior Art)
FIG. 2 is a perspective view of a portion of the same engine cylinder head, but including a cutaway to reveal an area of the cylinder head that may incorporate an engine component according to the present disclosure.

Referring now also to FIG. 2, a cutaway portion of the subassembly 12 reveals an engine component, for example a thermostatic valve 14 as shown, which during assembly of an engine may be inserted prior to installation thereover of a cooling conduit such as an elbow sleeve 16. As such, the elbow sleeve 16 may fit over the thermostatic valve 14, and a flange 18 of the elbow sleeve 16 may then be secured to the cylinder head 10, over the thermostatic valve 14, as further described below.

Figure 3:
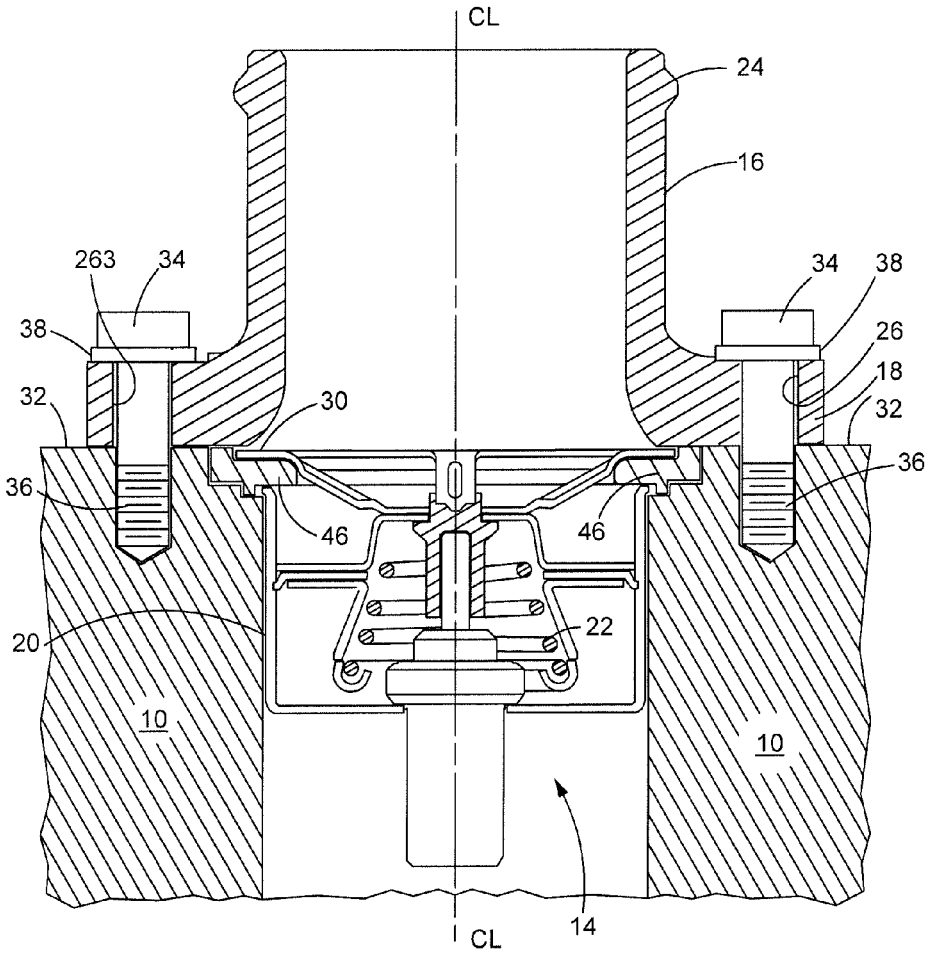
FIG. 3 (Prior Art)
FIG. 3 is a cross-sectional elevation view of a prior art engine component, shown secured in place against a prior art elbow sleeve, that may be selectively replaceable with the as-disclosed engine component having an installation feature, and in accordance with a disclosed error avoidance method.

Referring now also to FIG. 3, the thermostatic valve 14, shown oriented along an axis "a-a", may incorporate a water temperature sensitive wax element (not shown), along with a spring 22 which may be effective to move and open a valve whenever the wax element has been sufficiently heated, as will be well known to those skilled in the art. The prior art housing 20 includes a top flange 30. The flange 30 is effectively trapped between an upper mating surface 32 of the cylinder head 10 and a bottom flange 18 of the elbow sleeve 16, although a rubber seal 46 may be physically interposed between the top flange 30 and the mating surface 32, as will be appreciated by those skilled in the art. Typically such rubber seal 46 may be part of the assembled structure of the thermostatic valve 14. Alternatively such seal 46 may be a separately installed part.

Bolts 34 extend through apertures 26 of the flange 18, the bolts 34 having threaded shafts 36 that extend into the mating surface 32 for direct threaded securement to the cylinder head 10, as shown. Washers 38 may be interposed between the bolts 34 and the elbow sleeve flange 18 to aid in achievement of proper torquing of the bolts with respect to the flange 18 and the mating surface 32 of the cylinder head 10. Those skilled in the art will also appreciate that an annular exterior ridge 24 may be effective for the later securement of a rubber hose (not shown) that may extend between the engine cylinder head 10 and a radiator (not shown).

Figure 4:
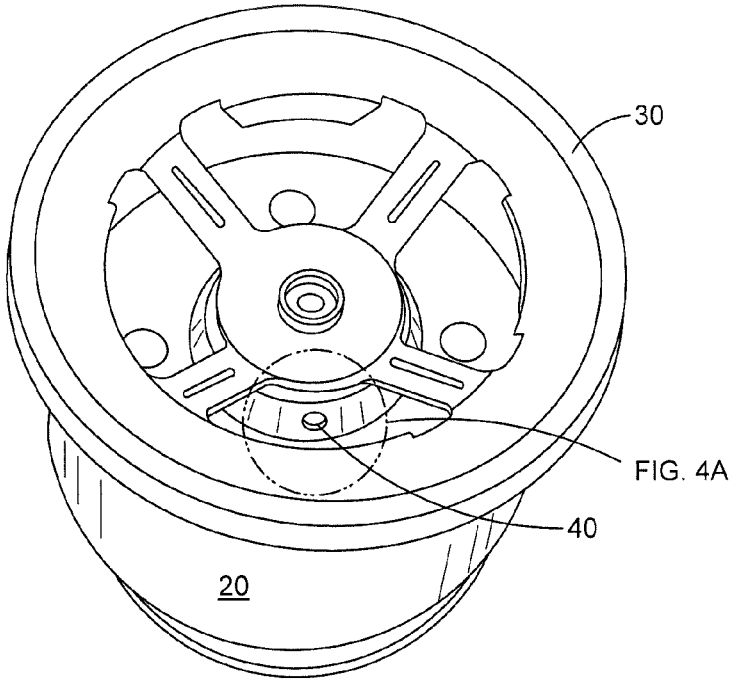
FIG. 4 (Prior Art)
FIG. 4 is a perspective view of the upper portion of the prior art engine component of FIG. 3, but shown alone; i.e. apart from the elbow sleeve, to reveal specific structure.
Figure 4A:
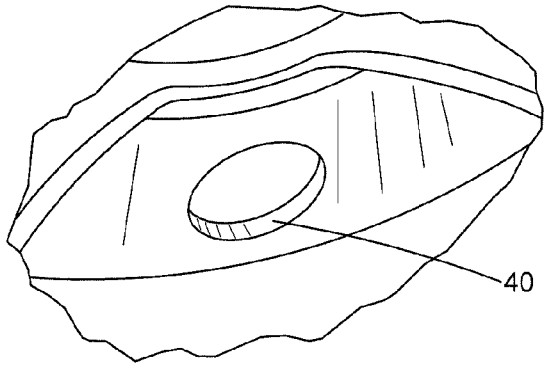
FIG. 4A (Prior Art)
FIG. 4A is a perspective view of a selected (encircled) portion of FIG. 4.

FIG. 4 depicts a view of the thermostatic valve 14 that reveals the top flange 30 that may define an upper extremity of the housing 20, as described above. Referring now also to FIG. 4A, a vent 40 is defined by an aperture that may be included in the prior art thermostatic valve 14, the vent being situated in an upper portion of the housing 20. The vent 40 may allow a small amount of coolant to flow into the radiator (not shown) even when the thermostatic valve 14 may be in the "closed" position. Such a coolant flow may help to avoid an otherwise potentially deleterious thermal shock to the radiator that might arise from the opening of the thermostatic valve 14 after the coolant has reached a predetermined temperature. In some applications, however, the small amount of coolant flow through the vent 40 is enough to undesirably delay (or even prevent) sufficient warming of coolant in the engine, as for example when ambient air may be extremely cold, e.g. minus 20 C, and the engine may be operating at relatively low RPM's. The vent 40 may lead to excessive cooling, and hence deleterious performance or even failure issues.

Figure 5:
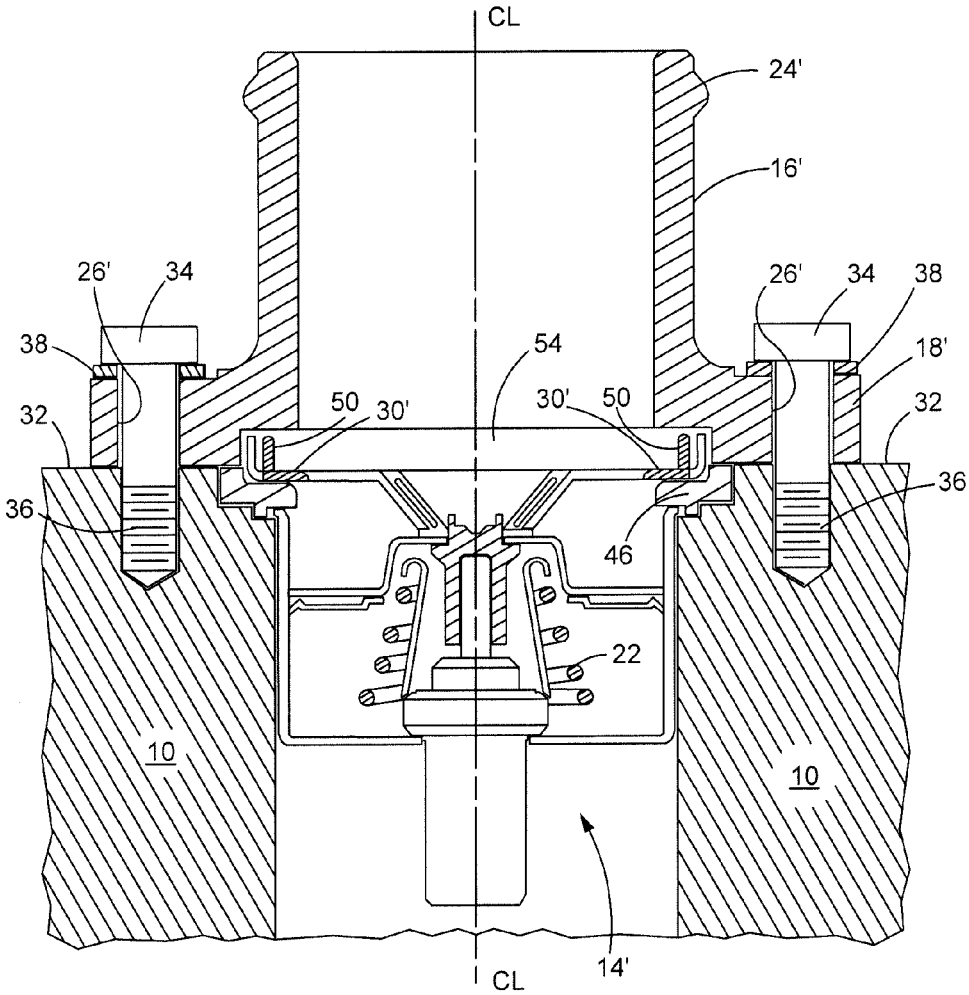
FIG. 5 is a cross-sectional elevation view of an engine component having the disclosed installation feature, shown mated to an as-disclosed modified elbow sleeve.

As such, referring now to FIG. 5, a ventless thermostatic valve 14', may be oriented along an axis "b-b" upon its installation within the cylinder head 10, and may provide an alternative structure for engines having operating characteristics that call for use of ventless thermostatic valves, e.g. to prevent issues of excessive cooling in certain applications. The ventless thermostatic valve 14' may be both operationally and physically identical in all respects to the prior art thermostatic valve 14, except for inclusion of the vent 40 of the prior art thermostatic valve 14. Indeed, the thermostatic valves 14 and 14' may be visually similar in overall design and appearance, including size, color, and shape, such as the elongated shape disclosed.

Figure 7:
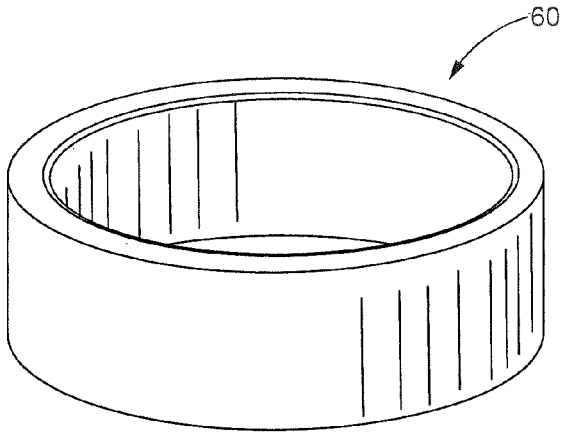
FIG. 7 is a perspective view of a shoulder ring, in accordance with another embodiment.

In order to reduce potential misassembly of the two engine components, i.e. the respective thermostatic valves 14 and 14', an installation feature such as a pair of upstanding tabs 50 may be formed as a modified top flange 30' in the ventless thermostatic valve 14', as shown. To accommodate the tabs, a modified elbow sleeve 16' may contain a flange 18' that includes a widened shoulder, as may be defined by a recessed groove 54, adapted to receive the tabs 50. As shown, the tabs may extend upwardly, parallel to axis b-b, but may have other viable orientations as well within the scope of this disclosure. The tabs 50 may be embodied by other structures that provide a protrusive installation feature adapted to be mated only with the flange 18' having a recessed groove 54, and hence to prevent assembly with a flange 18. As such, the protrusive installation feature may instead be a raised shoulder ring 60, as shown in FIG. 7, that extends entirely about the top flange 30' of the valve 14', by way of just one example.

Figure 6:
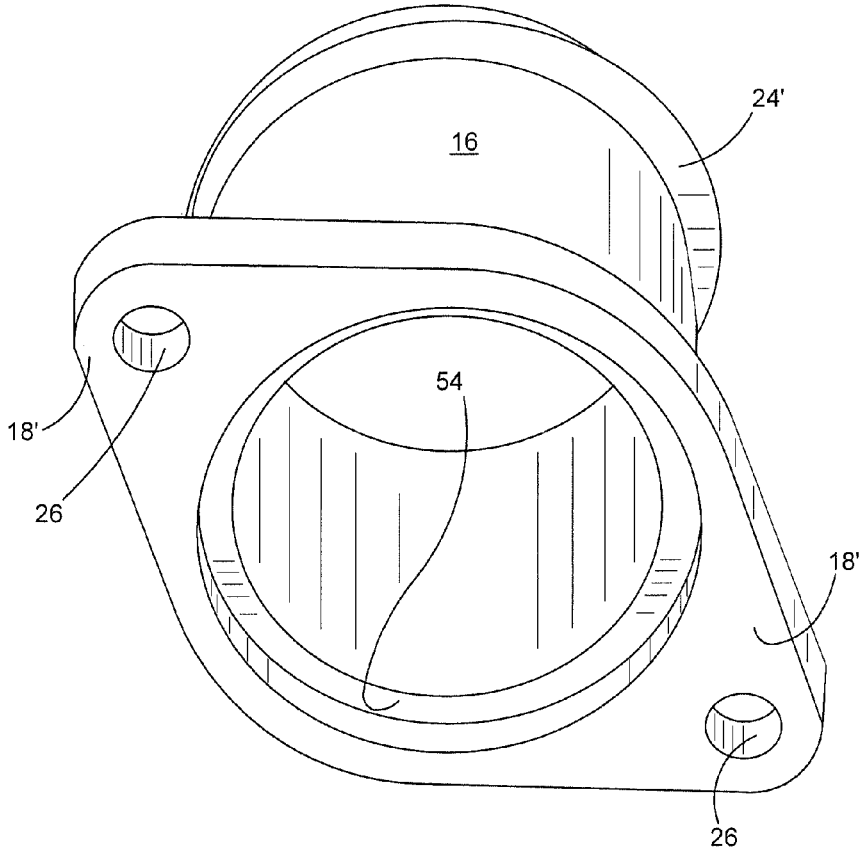
FIG. 6 is a perspective view of the modified elbow sleeve.
Figure 8:
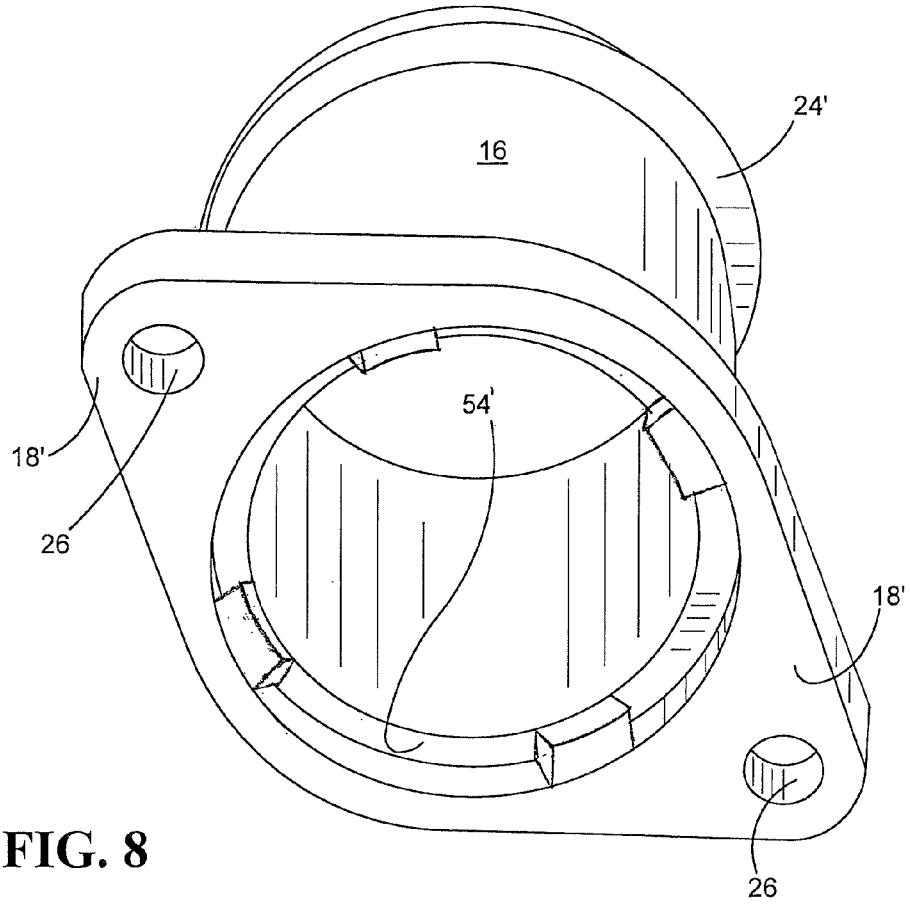
FIG. 8 is a perspective view of a modified elbow sleeve, in accordance with another embodiment.

Referring now to FIG. 6, a perspective view of the groove 54 within the modified flange 18' of the modified elbow sleeve 16' depicts a 360° circumferential recessed portion. Although the groove 54 is thus shown to extend entirely about the sleeve 16', the groove 54' may alternately be segmented as shown in FIG. 8, may extend less than 360°, and/or may otherwise be adapted to accommodate the tabs 50. However, it may be appreciated by those skilled in the art that the 360° circumferential extent of the groove 54 may permit a greater amount of flexibility with respect to angular positioning of the flange 18' over the cylinder head mating surface 32 during assembly.

Finally, a specific process or method adapted to utilize the above-described tab and groove engine component installation features will be specifically detailed below.

INDUSTRIAL APPLICABILITY

The disclosed installation distinguishing feature may be adapted for reducing the potential selection of and misassembly of one engine component over another component, such as the installation of thermostatic valve 14 over a thermostatic valve 14', for example. The installation feature may thus be beneficial in the assembly of engines for a variety of machines, including wheel loaders, excavators, tractors, trucks, and other off-road machines. As disclosed herein, the described installation feature may be used to avoid potentially damaging consequences of operating engines containing misassembled parts.

A method for ensuring that substantially visually similar engine components, such as thermostatic valves 14 and 14', are not misassembled, i.e. and by way of example, in a situation wherein a vented thermostatic valve 14 is utilized, but wherein a ventless thermostatic valve 14' should have been used, may now be particularly described as follows.

Referring back to FIG. 3, a prior art vented thermostatic valve 14 may contain a top flange 30 as previously described; i.e. without tabs 50. A standard elbow sleeve 16 containing a standard ungrooved flange 18 may be paired with the vented thermostatic valve 14, and both components may be associated with an engine requiring the vented thermostatic valve. Conversely, referring now back to FIG. 5, a ventless thermostatic valve 14' may contain a modified top flange 30', containing at least a pair of the upstanding tabs 50. The thermostatic valve 14' may be paired with a sleeve 16' that contains a modified flange 18', in turn containing the recessed groove 54, as shown.

Those skilled in the art will appreciate that the use of two modified parts reduces the statistical risk of mistakes over the use of only a single modified part. As such, the thermostatic valve 14' along with the sleeve 16' may be correspondingly associated with an engine requiring a ventless thermostatic valve, so as to avoid overcooling of the latter engine of the type requiring a ventless thermostatic valve 14'.

A protocol may be set up for managing such respective engine components, and in particular to keep them separately arranged for appropriate use by engine assembly workers. Thus, an engine component installation method for reducing probability of misinstallation of apparently similar albeit different first and second engine components within first and second engines having different operating characteristics may be described as follows:

a) providing an engine component installation distinguishing feature on a first engine component to differentiate the first engine component from a second engine component;

b) identifying and modifying a part to be secured to the first engine component to accommodate the installation feature of the first engine component, wherein the first engine component and the modified part define a first subassembly;

c) identifying an unmodified part to be secured to the second engine component, wherein the second engine component and its unmodified part define a second subassembly;

d) associating the first and second engine subassemblies with one of the first and second engines, respectively; and e) providing a system for managing pluralities of first and second engine subassemblies, including keeping the respective subassemblies apart from one another prior to and during respective first and second engine assembly processes.

Such a component management protocol may effectively achieve the intended result, i.e. avoiding misassembly of one component when another component is called for. In the event, however, of a mis-association, i.e. if a tabbed thermostatic valve 14' may be attempted to be used with a standard elbow sleeve 16, the assembler will receive immediate tactile feedback as an indication of a misassembly problem, since the upstanding tabs 50 will directly interfere with efforts to secure the bolts 34 that extend through the flange 18 of the standard or unmodified elbow sleeve 16. As such, the assembler will be unable to properly secure the bolts 34 through the flange 18 for effective securement thereof against the mating surface 32 of the cylinder head 10. As such, the assembler may thus receive instant notice of undesirable interference.

Finally, even if such interference is missed by an engine assembler during an engine assembly, a subsequent leak test may be effective to reveal the misassembly issue, to the extent that the bolts 34 will have been unable to effectively secure the flange 18 against the mating surface 32 in a leak-proof fashion. While a vented valve 14 may be mated with the flange 18' as a misassembly, with the vented valve being assembled to a non-vented engine, such a failure would not necessarily lead to major issues. Conversely, however, the opposite type of mis-assembly, i.e. a non-vented valve 14' being mated to an engine that requires a vent, may be problematic. The latter potential misassembly may be effectively prevented by the apparatus of this disclosure.

What is claimed is:

1. A thermostatic valve for an engine subassembly, the thermostatic valve configured to be positioned in a bore of a cylinder head of the engine subassembly; the thermostatic valve comprising:

an upper radially extending first flange configured to extend between an upper mating surface of the cylinder head and an elbow sleeve, and a protrusive installation feature disposed circumferentially about the first flange, the protrusive installation feature extending upwardly from the first flange and parallel to an axis of the bore of the cylinder head, the protrusive installation feature configured to fit between a circumferential groove of the elbow sleeve and the upper mating surface of the cylinder head, the protrusive installation feature configured to be positioned radially outward of the bore of the cylinder head and proximate to the upper mating surface when the first flange is in proximity thereto.

2. The thermostatic valve of claim 1, wherein the protrusive installation feature is a pair of tabs.

3. The thermostatic valve of claim 1, wherein the protrusive installation feature is a shoulder ring.

4. The thermostatic valve of claim 1, wherein the thermostatic valve is ventless.

5. The thermostatic valve of claim 1, wherein the circumferential groove of the elbow sleeve shares a common axis with the thermostatic valve.

6. An engine subassembly comprising:

a cylinder head including a bore extending from an upper mating surface thereof;

an elbow sleeve secured to the upper mating surface of the cylinder head, the elbow sleeve including a recessed groove proximate to the upper mating surface; and a thermostatic valve disposed within the bore of the cylinder head, the thermostatic valve including a first flange extending radially outward, and a protrusive installation feature disposed circumferentially about the first flange, the protrusive installation feature extending upwardly from the first flange and parallel to an axis of the bore of the cylinder head, the protrusive installation feature positioned radially outward of the bore of the cylinder head and configured to fit within the recessed groove of the elbow sleeve.

7. The engine subassembly of claim 6, wherein the thermostatic valve is ventless.

8. The engine subassembly of claim 6, wherein the recessed groove of the elbow sleeve shares a common axis with the thermostatic valve.

9. The engine subassembly of claim 6, wherein the elbow sleeve includes a second flange configured to receive bolts for securement of the elbow sleeve to the cylinder head.

10. The engine subassembly of claim 6, wherein the recessed groove of the elbow sleeve extends 360° about an inner diameter of the elbow sleeve.

11. The engine subassembly of claim 6, wherein the recessed groove of the elbow sleeve extends less than 360° about an inner diameter of the elbow sleeve.

* * * * *